US008164436B2

(12) United States Patent
Baird, III et al.

(10) Patent No.: US 8,164,436 B2
(45) Date of Patent: Apr. 24, 2012

(54) POWER OVER DATA CABLE SYSTEM AND METHOD

(75) Inventors: Leemon Claude Baird, III, Colorado Springs, CO (US); John Kelly Hughes, San Jose, CA (US)

(73) Assignee: Bluewave Security, Austin, TX (US)

( * ) Notice: Subject to any disclaimer, the term of this patent is extended or adjusted under 35 U.S.C. 154(b) by 467 days.

(21) Appl. No.: 12/072,862

(22) Filed: Feb. 28, 2008

(65) Prior Publication Data

US 2008/0204220 A1 Aug. 28, 2008

Related U.S. Application Data

(60) Provisional application No. 60/904,150, filed on Feb. 28, 2007.

(51) Int. Cl.
*G08B 29/02* (2006.01)

(52) U.S. Cl. ..... 340/506; 340/533; 340/538; 340/12.32

(58) Field of Classification Search ..... 340/506, 340/533, 516–517, 541–567, 568.1–568.8, 340/310.11–310.18, 538–538.17, 693.1, 340/12.32–12.39, 13.23, 288; 361/91.1; 323/205; 713/300

See application file for complete search history.

(56) References Cited

U.S. PATENT DOCUMENTS

| | | | | |
|---|---|---|---|---|
| 5,070,442 | A * | 12/1991 | Syron-Townson et al. | 700/17 |
| 5,521,585 | A * | 5/1996 | Hamilton | 340/628 |
| 5,552,766 | A * | 9/1996 | Lee et al. | 340/541 |
| 5,568,124 | A * | 10/1996 | Joyce et al. | 340/550 |
| 2002/0171546 | A1 * | 11/2002 | Evans et al. | 340/540 |
| 2003/0214405 | A1 * | 11/2003 | Lerg et al. | 340/565 |
| 2007/0075586 | A1 * | 4/2007 | Bogue | 307/66 |
| 2007/0288784 | A1 * | 12/2007 | Koper et al. | 713/324 |

* cited by examiner

*Primary Examiner* — Toan N Pham
(74) *Attorney, Agent, or Firm* — Dale B Halling

(57) ABSTRACT

A power over data cable system has a power controller. The power controller receives alarm signals from alarm systems such as fire alarms and security alarms. The power controller is connected to power over Ethernet switches or injectors (PoE). The PoE Ethernet switches or injectors are coupled network devices, such as door locks, security cameras, etc. When an alarm occurs, the power controller can turn off the power to the network devices by sending a disable signal to an associated PoE Ethernet switch or injector. A user interface, allows a user to easily define which PoE Ethernet switches or injectors are to be opened for a given alarm. Using this system the user can easily setup a system to selectively disable power to certain devices and not others whenever an alarm is activated.

15 Claims, 2 Drawing Sheets

POWER OVER DATA CABLE SYSTEM AND METHOD

RELATED APPLICATIONS

The present invention claims priority on provisional patent application, Ser. No. 60/904,150, filed on Feb. 28, 2007, entitled "Automated Control of Power over Ethernet" and is hereby incorporated by reference.

STATEMENT REGARDING FEDERALLY SPONSORED RESEARCH

Not Applicable

THE NAMES OF THE PARTIES TO A JOINT RESEARCH AGREEMENT

Not Applicable

REFERENCE TO A SEQUENCE LISTING, A TABLE, OR A COMPUTER PROGRAM LISTING

Not Applicable

BACKGROUND OF THE INVENTION

Existing fire alarm systems are required by building codes to cut off power to doors in the case of a fire. Such power loss must result in fail safe operation with the door unlocked (in most cases) or fail secure operation with the door locked (which requires official approval). Existing Power Over Ethernet (POE) systems provide electrical power to devices (including but not limited to door locks) through the same Ethernet cable as is used for data communication. However, no existing system integrates the fire alarm system with the POE system to selectively disable power to certain devices and not others whenever the fire alarm is activated. No existing system defines a standard interface for such operations. There is a great need for such systems.

BRIEF SUMMARY OF INVENTION

A power over data cable system that overcomes these and other problems has a power controller. The power controller receives alarm signals from alarm systems such as fire alarms and security alarms. The power controller is connected to power over Ethernet switches or injectors (PoE). The PoE Ethernet switches or injectors are coupled network devices, such as door locks, security cameras, etc. When an alarm occurs, the power controller can turn off the power to the network devices by sending a disable signal to an associated PoE Ethernet switch or injector. A user interface, allows a user to easily define which PoE Ethernet switches or injectors are to be opened for a given alarm. Using this system the user can easily setup a system to selectively disable power to certain devices and not others whenever an alarm is activated.

DETAILED DESCRIPTION OF THE INVENTION

The power over data cable system of the present invention has a power controller. The power controller receives alarm signals from alarm systems such as fire alarms and security alarms. The power controller is connected to power over Ethernet switches or injectors (PoE). The PoE Ethernet switches or injectors are coupled network devices, such as door locks, security cameras, etc. When an alarm occurs, the power controller can turn off the power to the network devices by sending a disable signal to an associated PoE Ethernet switch or injector. A user interface, allows a user to easily define which PoE Ethernet switches or injectors are to be opened for a given alarm. Using this system the user can easily setup a system to selectively disable power to certain devices and not others whenever an alarm is activated. Note as used herein power over data cable encompasses power over Ethernet and any other data communication standard.

Figure 1:
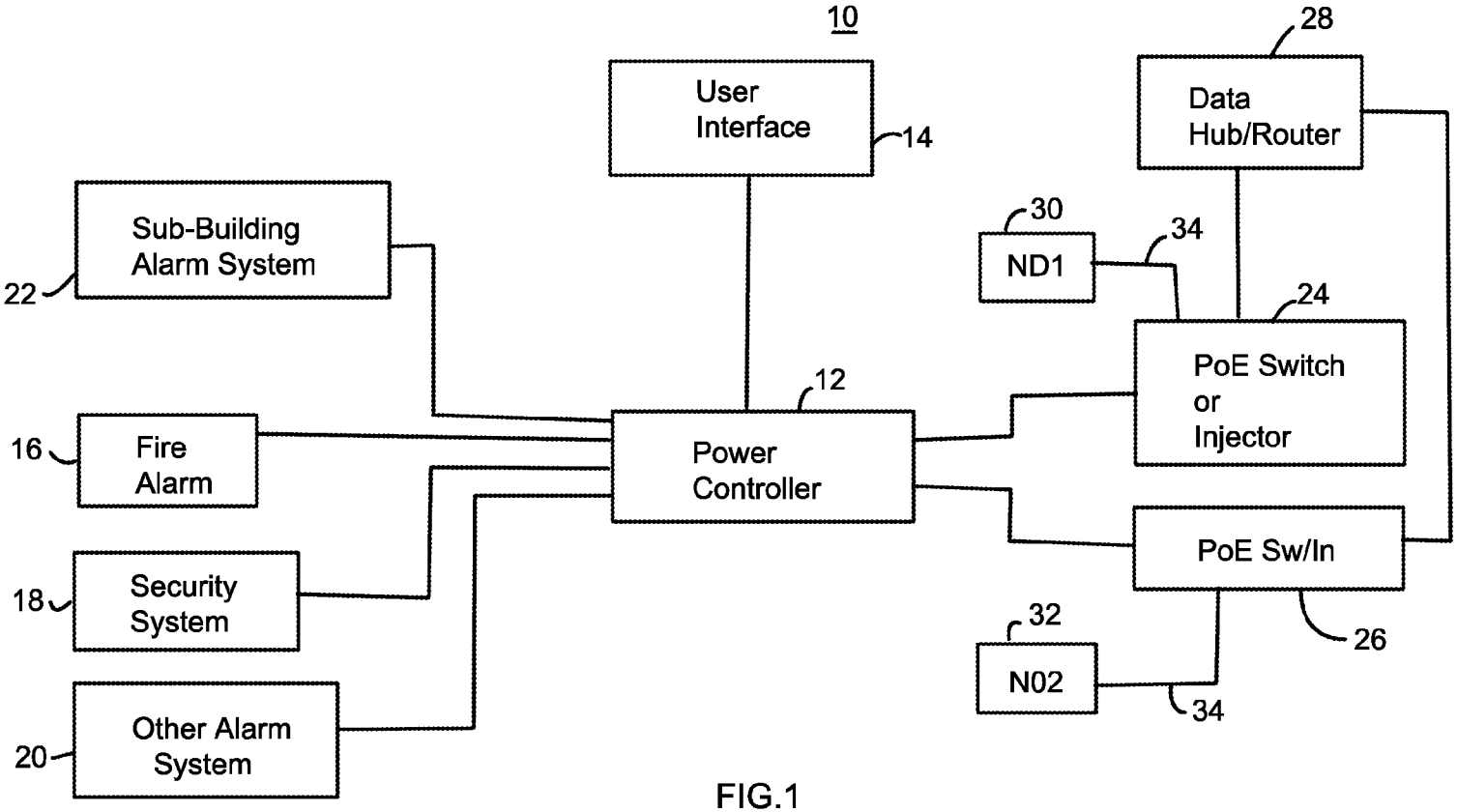
FIG. 1 is a block diagram of a power over data cable system in accordance with one embodiment of the invention.

FIG. 1 is a block diagram of a power over data cable system 10 in accordance with one embodiment of the invention. The system 10 has a power controller 12, which is connected to a user interface 14. The power controller 12 receives alarm signals from a fire alarm system 16, security system 18, other alarm systems 20 or sub-building alarm system 22. Sub-building alarm system 22 would be a security system for just a particular laboratory in a building, in one embodiment. Other alarm systems 20 may include flood alarms, tornado alarms, etc. The power controller 12 sends disable and reset signals to power over Ethernet (PoE) switches or injectors 24, 26. As used herein PoE switches and injectors are generally used interchangeably and PoE switches are more generally referred to as power over data cable switches. As a result, the invention encompasses other data communication standards than Ethernet. A PoE switch is generally built into a Ethernet (or data) hub or router 28, while a PoE injector is usually separate from the hub or router 28. The invention encompasses both situations seamlessly. The PoE switches 24, 26 are connected to a network devices 30, 32 respectively by data cables 34. A network device can be a door lock, a security camera, a telephone, etc.

The user selects using the user interface 12 which network devices 30, 32 are to be powered down when one of the alarm systems 16, 18, 20, 22 sends an alarm signal to the power controller 12. So the user may select that network device 30, which is a door lock in this example, should be powered down when there is a fire alarm. The door lock of this example is a security door lock and when power is removed it is unlocked. When an alarm signal is received from the fire alarm 16, a disable signal is sent to PoE switch 24. When the fire is contained a reset signal is sent from the power controller 12 to the PoE switch 24, which causes power to be applied to the network device 30. Note, that the reset can be performed by a physical control on the power controller 12, or remotely through a computer connected to the device (e.g. through a wired or wireless connected), or automatically through an "all clear" signal sent by the fire alarm panel or security system or whatever system sent the original alarm signal. The user interface 14 can either be physical controls on the power controller 12, or can be a remote control from a computer connected to the system. The power controller 12 contains nonvolatile memory that remembers the power controller 12. The power controller 12 inputs receive standard output signals from the fire alarm system. It then provides the user a standard interface 14 to the switch 24, 26, which is useful because each major manufacturer of switches provides a different, proprietary interface.

Figure 2:
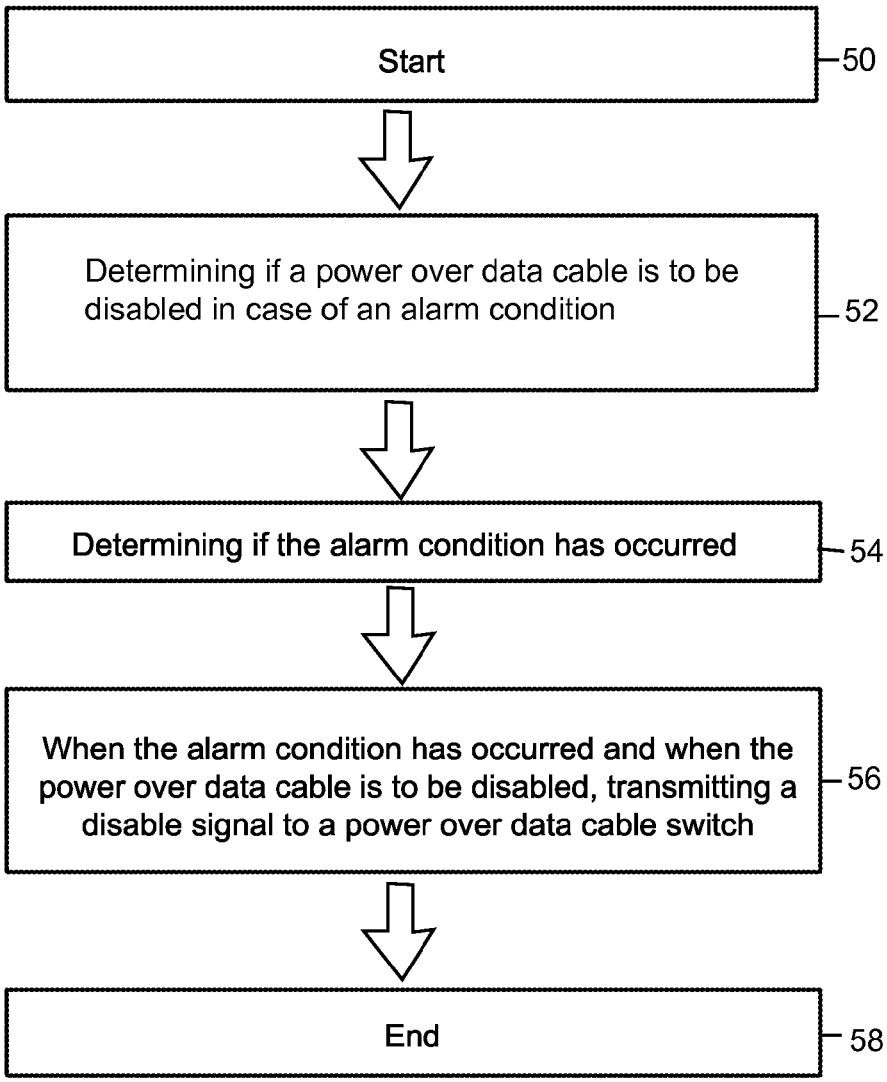
FIG. 2 is a flow chart of the steps used in a method of operating a power over data cable system in accordance with one embodiment of the invention.

FIG. 2 is a flow chart of the steps used in a method of operating a power over data cable system in accordance with one embodiment of the invention. The process starts, step 50, by determining if a power over data cable is to be disabled in case of an alarm condition at step 52. Next it is determined if the alarm condition has occurred at step 54. When the alarm condition has occurred and when the power over data cable is to be disabled at step 56, transmitting a disable signal to a power over data cable switch, which ends the process step 58. Next the power over data cable switch is opened. Then it is determined if a reset condition has occurred. When the reset condition has occurred, a close signal is transmitted to the power over data cable switch. This closes the power over data cable switch.

Thus there has been described a system the user can easily setup a system to selectively disable power to certain network powered devices and not others whenever an alarm is activated.

While the invention has been described in conjunction with specific embodiments thereof, it is evident that many alterations, modifications, and variations will be apparent to those skilled in the art in light of the foregoing description. Accordingly, it is intended to embrace all such alterations, modifications, and variations in the appended claims.

What is claimed is:

1. A power over ethernet control system, comprising:

an alarm system for detecting an alarm condition;

a power controller having an input coupled to the alarm system, the power controller supplying power to a network device door lock;

a PoE switch associated with the network device door lock, receiving a power down signal from the power controller when the alarm condition is detected by the alarm system.

2. The system of claim 1, further including a data cable between the PoE switch and the network device.

3. The system of claim 2, further including a user interface for selecting if the PoE switch is powered down in case of the alarm condition.

4. The system of claim 3, wherein the alarm system is a fire alarm system.

5. The system of claim 3, wherein the alarm system is a security system.

6. The system of claim 3, wherein the alarm system is a segment of a building alarm system.

7. The system of claim 1, further including a PoE injector receiving an associated power down signal from the power controller.

8. A method of operating a power over data cable system, comprising the steps of:

a) determining if a power over data cable is to be disabled in case of a fire alarm condition;

b) determining if the fire alarm condition has occurred; and c) when the fire alarm condition has occurred and when the power over data cable is to be disabled, transmitting a disable signal to a power over data cable switch.

9. The method of claim 8, further including the step of:

d) opening the power over data cable switch.

10. The method of claim 9, further including the steps of:

e) determining if a reset condition has occurred;

f) when the reset condition has occurred, transmitting a close signal to the power over data cable switch.

11. The method of claim 10, further including the step of:

g) closing the power over data cable switch.

12. The method of claim 8, further including the step of turning off power to a door lock.

13. The method of claim 8, wherein the step of determining if the power over data cable is to be disabled, includes the step of determining if the power over data cable is to be disabled when there is a security alarm.

14. A power over data cable system, comprising:

a fire alarm system for detecting a fire alarm condition;

a power controller having an input coupled to the fire alarm system;

a user interface in communication with the power controller;

a data cable connected to the power controller;

a power over data cable switch, a power down signal transmitted over the data cable from the power controller to the power over data cable switch when the fire alarm condition exists; and a door lock connected by the data cable to the power over data cable switch.

15. The system of claim 14, further including a power over data cable injector, a second power down signal connecting the power controller to the power over data cable injector.

* * * * *